US011203902B2

(12) United States Patent
MacKay et al.

(10) Patent No.: US 11,203,902 B2
(45) Date of Patent: Dec. 21, 2021

(54) GUIDE SHOE WITH LOCKABLE NOSE

(71) Applicant: DOWNHOLE PRODUCTS LIMITED, Aberdeen (GB)

(72) Inventors: Alexander Craig MacKay, Aberdeen (GB); Jonathan Peter Buckland, Inverurie (GB)

(73) Assignee: DOWNHOLE PRODUCTS LIMITED, Portlethen (GB)

( * ) Notice: Subject to any disclaimer, the term of this patent is extended or adjusted under 35 U.S.C. 154(b) by 0 days.

(21) Appl. No.: 17/049,246

(22) PCT Filed: May 2, 2019

(86) PCT No.: PCT/IB2019/053605
§ 371 (c)(1),
(2) Date: Oct. 20, 2020

(87) PCT Pub. No.: WO2019/234519
PCT Pub. Date: Dec. 12, 2019

(65) Prior Publication Data

US 2021/0246730 A1 Aug. 12, 2021

(30) Foreign Application Priority Data

Jun. 5, 2018 (GB) ..... 1809145

(51) Int. Cl.
*E21B 17/14* (2006.01)
*E21B 7/20* (2006.01)

(52) U.S. Cl.
CPC ..... *E21B 7/20* (2013.01); *E21B 17/14* (2013.01)

(58) Field of Classification Search
CPC ..... E21B 17/14
See application file for complete search history.

(56) References Cited

U.S. PATENT DOCUMENTS 1,471,775 A * 10/1923 Brown ..... E21B 31/18 294/86.18
2,436,506 A * 2/1948 Edwards ..... E21B 31/18 294/86.2

(Continued)

FOREIGN PATENT DOCUMENTS

CN 102278080 A 12/2011
GB 2333542 A 7/1999

OTHER PUBLICATIONS

UK Search Report for Application No. 1809145.4 dated Jun. 26, 2018.

*Primary Examiner* — Kipp C Wallace

(57) ABSTRACT

A guide shoe (1), adapted for connection to an end of a tubular for deployment in a wellbore of an oil, gas, or water well, includes: a body (10) having an axis (2) and being adapted for connection to the tubular such that torque can be transmitted between the tubular and the body (10); a nose (50) adapted for connection to the body (10); a locking mechanism (30) adapted to shift between an unlocked configuration, in which rotation of the nose (50) around the axis of the body (10) is permitted in first and second directions, and a locked configuration in which rotation of the nose (50) around the axis of the body (10) is restricted in at least one of the first and second directions. The guide shoe includes a resilient biasing device (20) urging the nose (50) into the locked configuration.

13 Claims, 4 Drawing Sheets

(56) References Cited

U.S. PATENT DOCUMENTS

| | | | | |
|---|---|---|---|---|
| 2,893,491 | A * | 7/1959 | Crowe | E21B 23/06 175/315 |
| 3,912,014 | A * | 10/1975 | Wetzel | E21B 23/006 166/384 |
| 5,669,443 | A | 9/1997 | Budde | |
| 6,443,247 | B1 | 9/2002 | Wardley | |
| 7,275,605 | B2 | 10/2007 | Smith | |
| 7,681,637 | B2 | 3/2010 | Frazier | |
| 2007/0199694 | A1* | 8/2007 | Frazier | E21B 17/14 166/242.8 |
| 2013/0327575 | A1 | 12/2013 | Twardowski | |
| 2016/0090816 | A1* | 3/2016 | Gosselin | E21B 33/14 166/332.1 |

* cited by examiner

GUIDE SHOE WITH LOCKABLE NOSE

BACKGROUND OF THE DISCLOSURE

Field of the Disclosure

The present disclosure generally relates to a guide shoe with a lockable nose.

Description of the Related Art

U.S. Pat. No. 5,669,443 discloses a shoe for attachment to a length of casing for use in a wellbore including a body portion attachable to casing, and a nose portion rotatably mounted on the body portion. A casing string with a plurality of casing sections and such a shoe.

U.S. Pat. No. 6,443,247 discloses a casing drilling shoe adapted for attachment to a casing string and including an outer drilling section constructed of a relatively hard material such as steel and an inner section constructed of a readily drillable material such as aluminum. The drilling shoe further includes a device for controllably displacing the outer drilling section to enable the shoe to be drilled through using a standard drill bit and subsequently penetrated by a reduced diameter casing string or liner.

U.S. Pat. No. 7,275,605 discloses a rotatable drilling shoe attachable to a section of casing that allows for drilling and casing of a well bore in a single trip. The drilling shoe includes a fixed section and a rotatable section that has a drillable bit attached thereto. The drilling shoe further includes a mechanism for inhibiting rotation of the rotatable section after the casing is cemented into place so that the drillable bit can be drilled out by a subsequent drilling operation.

U.S. Pat. No. 7,681,637 discloses a guide shoe that utilizes an eccentric nose attached to a cylindrical body that has spiraled, ridged blades extending outward from the body. An orientation system is attached between the body and a hollow shaft. The orientation system is designed to allow free rotation of the body and nose about the shaft during the insertion of the tubing into the hole. It does this by providing clearance between a pawl and notches on the cylindrical body. Indexing of the eccentric nose is provided by a slight retraction of the tubing string in the well hole. Friction between the well hole and ridged blade causes the cylindrical body to rotate about the shaft and lock into an oriented position. The guide shoe is attached to the tubing string by a threaded female connection mating to the matching male connection on the tubing string.

US 2013/0327575 discloses an earth removal member for drilling a wellbore with casing or liner includes a tubular body and a head. The head is fastened to or formed with an end of the body, has a face and a side, is made from a high strength material, and has a port formed through the face. The earth removal member further includes a blade. The blade is formed on the head, extends from the side and along the face, and is made from the high strength material. The earth removal member further includes cutters disposed along the blade; and a nozzle adapter. The nozzle adapter has a port formed therethrough, is longitudinally and rotationally coupled to the head, and is made from a drillable material. The earth removal member further includes a nozzle disposed in the adapter port and fastened to the nozzle adapter.

SUMMARY OF THE DISCLOSURE

The present disclosure generally relates to a guide shoe with a lockable nose. In one embodiment, a guide shoe, adapted for connection to an end of a tubular for deployment in a wellbore of an oil, gas, or water well, includes: a body having an axis and being adapted for connection to the tubular such that torque can be transmitted between the tubular and the body; a nose adapted for connection to the body; a locking mechanism adapted to shift between an unlocked configuration, in which rotation of the nose around the axis of the body is permitted in first and second directions, and a locked configuration in which rotation of the nose around the axis of the body is restricted in at least one of the first and second directions. The guide shoe includes a resilient biasing device urging the nose into the locked configuration.

Optionally the locking mechanism is arranged to shift from the locked to the unlocked configuration in response to compressive force applied to the nose along the axis of the body. Optionally the locking mechanism is arranged to shift from the locked to the unlocked configuration in response to axial movement of the nose relative to the body, e.g. movement of the nose into the bore of the body.

Optionally the resilient biasing device is maintained in compression. Optionally the resilient biasing device is adapted to be energised (e.g. to compress) in response to compressive force applied to the nose along the axis of the body. Optionally the compressive force is applied to the nose as a result of the progress of the tubular through the wellbore being interrupted by an obstruction in the wellbore such as a ledge or other radial protrusion engaging the nose and resisting passage of the nose past the obstruction as the tubular (or string of tubulars) continues to move into the wellbore. Optionally the compressive force applied to the nose along the axis of the body can have a radial component as well as an axial component. In other words, the force applied to the nose could be aligned with the axis or not. In many cases, where the force is applied by a ledge or other obstruction extending radially from the sidewall of the wellbore, the force will have a radial component and an axial component.

In this disclosure reference is made to rotation of various components in clockwise and counter-clockwise directions and all such directions, unless the context requires otherwise, are expressed as viewed from the end of the component closest to the surface in the wellbore, i.e. looking down on the string from the surface. In the vast majority of oil well drilling operations using conventional equipment and methods, rotary drilling is accomplished by turning the string clockwise or "to the right" as viewed from the upper end of the string.

Optionally in the unlocked configuration the nose can rotate freely around the axis of the body in both first and second directions. Optionally in the locked configuration, the nose can rotate in the first direction (optionally counter-clockwise when viewed from the surface or the top of the string). Optionally in the locked configuration rotation of the nose is restricted or prevented in the second direction (optionally clockwise when viewed from the surface or the top of the string). When locked, the nose is optionally restricted (optionally prevented) from rotating counter-clockwise (when viewed from the surface or top of the string), permitting a conventional drilling operation to drill through the nose (with the drill bit rotating in a clockwise direction as explained above) when the locking mechanism is in the locked configuration.

Optionally the locking mechanism includes a lock ring having a profile which engages a profile on a portion of the nose. Optionally the profile on one of the lock ring and nose has at least one tooth, or two, three, four or more teeth, which engages in a pocket in the other of the lock ring and nose. Optionally the teeth can be arranged circumferentially around the axis of the body, optionally in a regular spacing. Optionally the tooth can engage in a pocket. Optionally the lock ring has a tooth which engages with a pocket on the nose which has a shape complementary to the tooth and which receives the tooth. Optionally the tooth has an incline and a decline. Optionally the incline and decline are not identical; one of the incline and the decline can optionally have a relatively steep slope or could comprise a shoulder which is parallel to the axis or which approaches parallel (e.g. within 10° of parallel), whereas the other could have a gradual slope. Optionally when the locking mechanism is in the locked configuration, the rotation of the nose in the first direction is permitted by relative sliding of the tooth and pocket along the gradual slope. Optionally the rotation of the nose in the second direction is prevented by abutting of the steep slope of the tooth with the steep slope of the pocket. Optionally the gradual slope offers some resistance to rotation of the nose around the axis in the first direction, for example, to rotate, it can be necessary that the force rotating the nose is sufficient to overcome the force applied by the resilient biasing device urging the locking mechanism into the locked configuration. The strength of the resilient biasing device when energised and optionally the slope of the teeth can be selected to make this threshold relatively low if desired, but it can be seen that the force threshold can be changed to fit the anticipated forces. Typically the forces applied to the nose when encountering obstructions in the well during running in can be relatively large, sufficient to overcome the force applied by the resilient biasing device. Typically this resistance can be overcome to permit rotation of the nose in the first direction when the locking mechanism is in the locked configuration.

Optionally the lock ring includes a split ring, for example, in the form of a C-shape, with a split permitting the free ends of the lock ring to be spread apart so that the lock ring can be opened up, e.g. to be placed around the nose. Optionally the nose has a groove which retains the lock ring, and which has a profile to engage with the tooth (or teeth) on the lock ring. Optionally the profile of the teeth on the lock ring is non-symmetrical, the teeth optionally having a general saw tooth shape. Optionally the inter-engaging tooth and pocket creates a one-way indexing system for rotation of the nose around the axis of the body, which permits at least one stop (optionally multiple stops) per rotation at an indexed position with movement only being possible in one direction, for example, in a series of irreversible steps, while the locking mechanism is in the locked configuration.

Optionally the groove has radial depth equal to or greater than the radial dimension of the lock ring, so that the lock ring can be received within the groove in the nose. Optionally the groove has an axial dimension that permits the lock ring to rotate within the groove without engaging the teeth with the pockets.

Optionally the lock ring is resilient, and is optionally energised to be radially compressed into the groove, and resiliently expands in a radial direction out of the groove. Optionally each of the body and the nose includes a groove that receives at least a portion of the lock ring. Optionally the resilient bias of the lock ring is chosen such that at rest, the lock ring adopts a radial position straddling the boundaries of the grooves in the nose and the body.

Optionally the resilient biasing device includes a coil spring, optionally held in compression, and adapted to urge the nose axially relative to the lock ring.

Optionally the lock ring is secured to the body, optionally by anti-rotation pins, which may also resist axial movement of the lock ring relative to the body. Optionally limited amount of axial movement of the lock ring is permitted, for example, by permitting sliding of the pin in an axial slot in the body, while resisting rotation of the lock ring relative to the body.

The lock ring is optionally radially expanded to fit over a section of the nose at the inner end of the nose (closest to the body and furthest from the free end of the nose) and once the expansion force is removed, the lock ring optionally radially contracts partially into the groove in the nose. Although the nose groove optionally has sufficient radial depth to receive the whole of the lock ring, the resilient bias of the lock ring is chosen such that at rest, the lock ring adopts a position partly in the groove and partly out, straddling the radial outer edge of the nose groove. The lock ring is then optionally compressed radially into the groove in the nose which can receive it within its radial depth, and the inner end of the nose is then optionally introduced into a bore in the outer end of the body which optionally compresses the resilient biasing device in the form of a coiled spring. The spring expands to urge the nose out of the bore of the body. The lock ring optionally radially expands into a groove formed in the inner surface of the bore of the body once that is aligned with the groove in the nose, and the expanded and resting lock ring optionally straddles the two grooves simultaneously thereby locking the nose and body together and maintaining the compression of the resilient biasing device.

The lock ring is then prevented from rotating with respect to the body by inserting anti-rotation pins through the body and locking into corresponding pockets in the lock ring. In some examples, the lock ring need not be biased into a groove in the body and the pins inserted through the body could lock the lock ring into the body rotationally and axially. In some other examples, an anti-rotation key may be inserted into the body prior to the lock ring/nose being pushed into the body and the cut in the lock ring aligned with the key to prevent rotation.

The resilient biasing member is kept in compression to keep the nose pushed forward from the bore in the body. Optionally this engages the locking mechanism in the locked configuration, in which the one way toothed profile allows the nose to rotate in one direction and lock in the reverse direction. However, if the nose is pushed back into the bore of the body, e.g. if the nose encounters an obstruction in the bore of the well, such as a restriction while the tubulars are run into the well, the locking mechanism will be unlocked, and the nose will be free to rotate with respect to the body.

The locking mechanism is designed to rotationally lock the nose to the body when the nose is being drilled through during a subsequent drilling or milling operation.

The locking mechanism does not need to form continuous locking profiles, it may comprise small numbers of locking teeth (or even one) with circumferential spaces in between, which will allow the nose to rotate freely clockwise or counter-clockwise for some of its circumference before a tooth engages a pocket.

In another embodiment, a method of deploying a tubular in a wellbore of an oil, gas, or water well includes: connecting a guide shoe on the end of the tubular. The guide shoe includes: a body having an axis and being adapted for connection to the tubular such that torque can be transmitted between the tubular and the body; a nose adapted for connection to the body; a locking mechanism adapted to shift between an unlocked configuration, in which rotation of the nose around the axis of the body is permitted in first and second directions, and a locked configuration in which rotation of the nose around the axis of the body is restricted in at least one of the first and second directions. The method further includes urging the nose into the locked configuration by a resilient biasing device.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
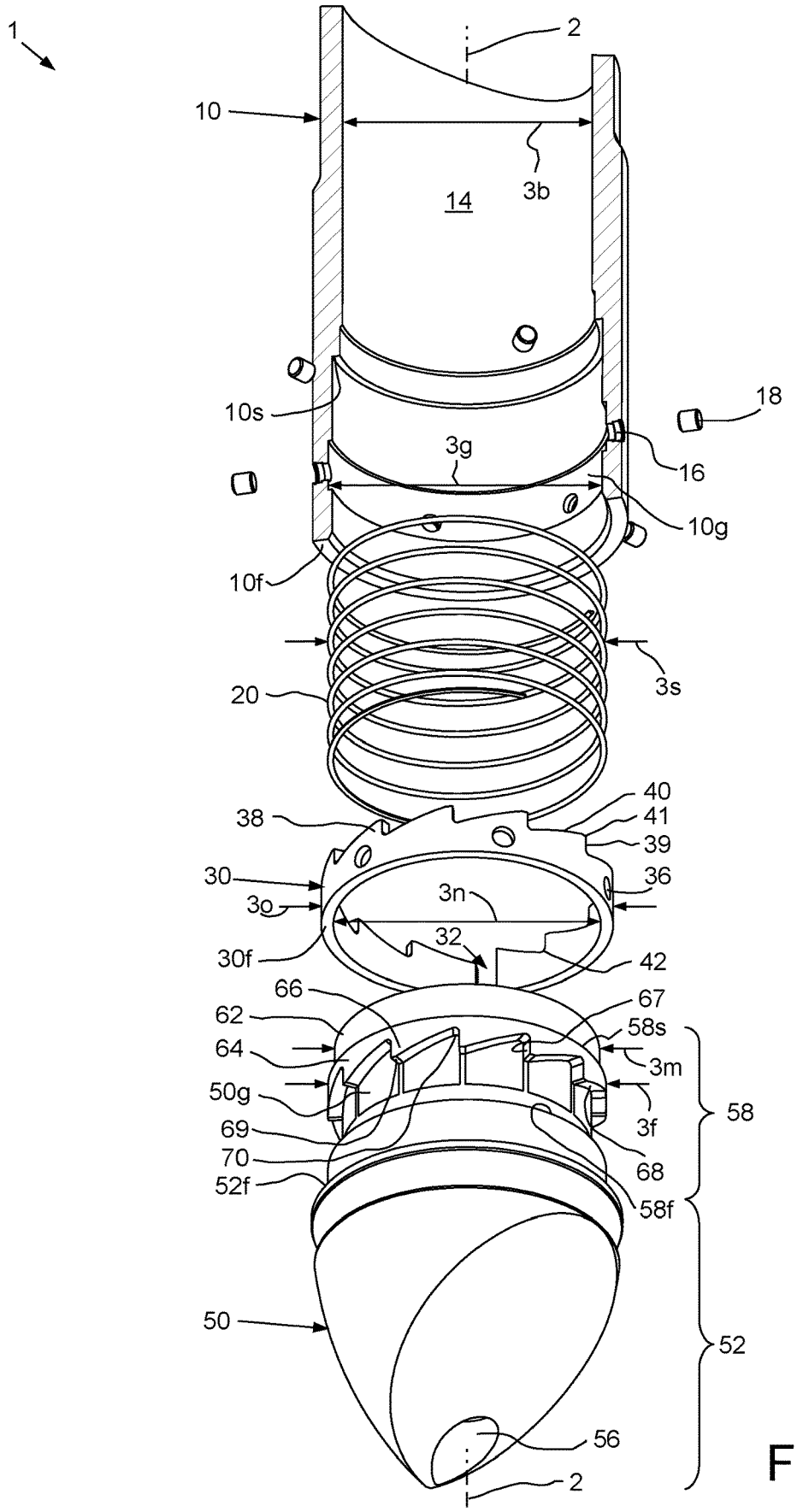
FIG. 1 is an exploded perspective view of a guide shoe with a lockable nose, according to one embodiment of the present disclosure.
Figure 2A:
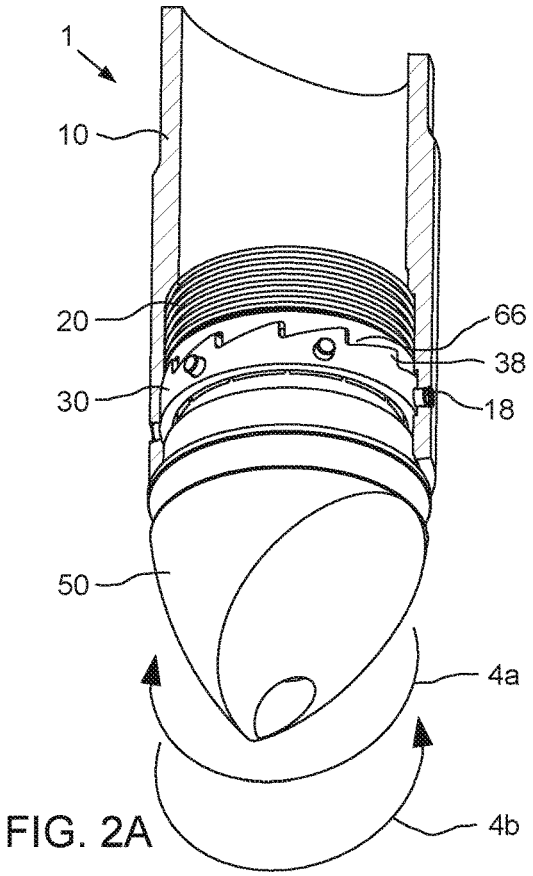
FIGS. 2A and 2B illustrate the guide shoe in the locked position.
Figure 2C:
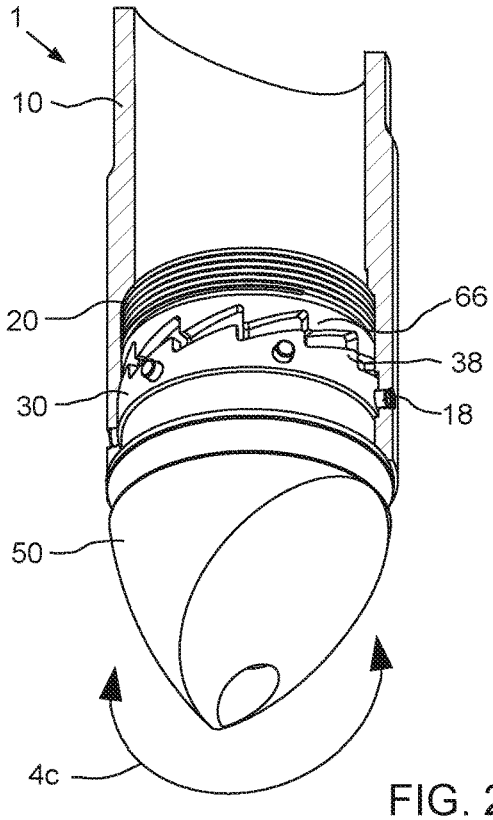
FIGS. 2C and 2D illustrate the guide shoe in the unlocked position.
Figure 2B:
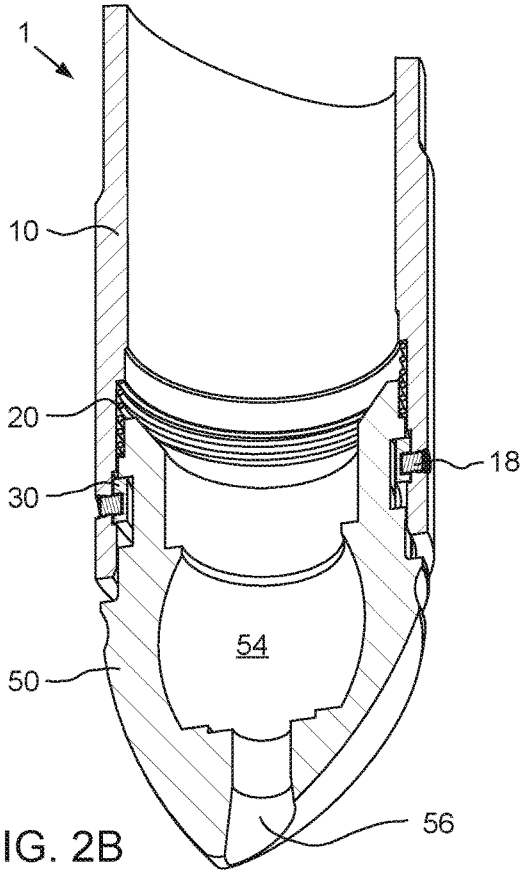
Figure 2D:
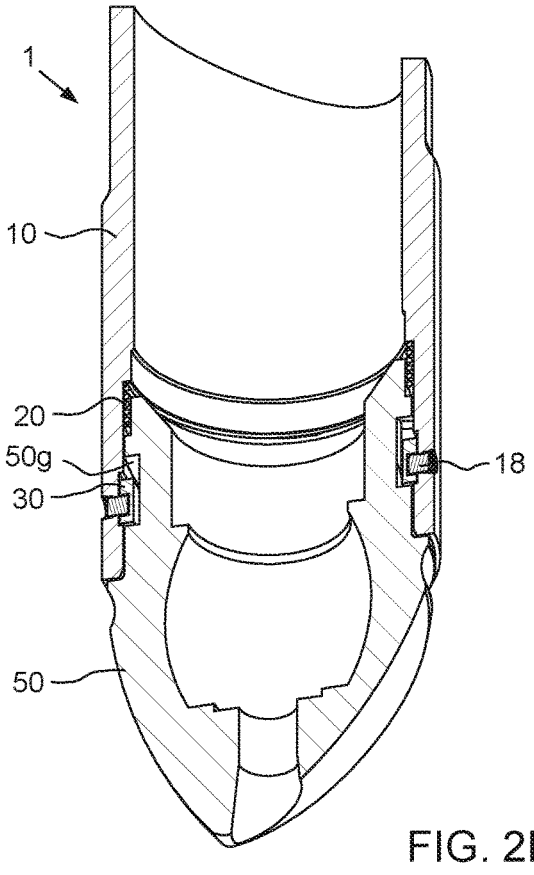

FIG. 1 is an exploded perspective view of a guide shoe 1 with a lockable nose 50, according to one embodiment of the present disclosure. FIGS. 2A and 2B illustrate the guide shoe 1 in the locked position. FIGS. 2C and 2D illustrate the guide shoe 1 in the unlocked position. The guide shoe 1 includes a body 10, a resilient biasing device in the form of a spring 20, a locking mechanism including a lock ring 30, and the nose 50.

The body 10 is generally cylindrically-shaped with a circular cross-section and has a bore with an axis 2. In this example the outer diameter of the body 10 has a box (not shown) with an internal thread at a second (upper) axial end of the body 10 which is adapted to connect to an externally threaded pin at the lower end of a tubing string such as casing or liner. The nose is connected to the body 10 at the opposing first (lower) axial end. The first end of the body 10 is counter-bored up to a circumferential shoulder 10*s* and the radially innermost surface 14 of the bore of the body 10 has a circumferential groove 10*g* within the counter-bored portion and close to the first end of the body 10. The groove 10*g* has a larger inner diameter 3*g* than the inner diameter 3*b* of the adjacent portions of the inner surface 14 of the body 10. In this example the inner diameter 3*g* of the groove 10*g* is constant. Also in this example, the groove 10*g* has a plurality of apertures 16 which extend through the wall of the body 10 between the inner and outer surfaces of the body 10. Each aperture 16 is generally circular and has an axis perpendicular to the axis of the body 10, and is axially disposed approximately midway along the axial width of the groove 10*g*. In this example there are six apertures 16 equidistantly spaced around the inner surface 14 of the groove 10*g*, but in other examples there may be fewer or more apertures, and the apertures 16 need not be spaced around the inner surface of the groove 10*g* equidistantly, regularly or symmetrically. Optionally the apertures are threaded internally to cooperate with threaded pins driven into the apertures.

The shoulder 10*s* is disposed further from the first axial end of the body 10 than the grove 10*g*, and is axially spaced from the groove 10*g*. The inner diameter 3*b* of the inner surface 14 of the body 10 on either axial side of the groove 10*g* is greater than the inner diameter of the body 10 above the shoulder 10*s*. In other words, the shoulder 10*s* is a stepped decrease in the inner diameter 3*b* of the body 10 from the first axial end of the body 10 toward the second axial end of the body 10. The shoulder 10*s* therefore presents a flat annular surface whose plane is perpendicular to the axis of the body 10. The body 10 is made from a metal or alloy, such as casing steel (i.e., API Specification 5CT).

The spring 20 is helically-shaped and has a bore with an axis which is coaxial with the axis of the body 10. The diameter 3*s* of the spring 20 is slightly smaller than the inner diameter 3*b* of the body 10 at either side of the groove 10*g*, but is larger than the inner diameter of the body 10 above the shoulder 10*s*. In this example the resting axial dimension of the spring when uncompressed is approximately equal to the axial depth of the shoulder 10*s* within the body 10, relative to the first axial end of the body 10, but in other examples the resting axial dimension of the spring 20 may be smaller or larger than the axial depth of the shoulder 10*s* within the body 10.

The lock ring 30 is generally cylindrically-shaped with a generally circular cross-section and has a bore with an axis which is also coaxial with the axis 2 of the body 10. The lock ring 30 includes an axial split or break 32 such that the lock ring 30 does not have a continuously circular cross-section but has a generally C-shaped profile. At rest, the two ends of the lock ring 30 in this example are circumferentially spaced apart with the split 32 between them, but in some examples, the two ends could optionally approach, or touch or even overlap at the split 32. In this example the lock ring 30 is formed from a resilient material such as spring steel. The split 32 therefore allows the inner and outer diameters 3*n,o* of the lock ring 30 to either increase into a radially expanded shape, or decrease into a radially compressed shape.

The outer diameter 3*o* of the lock ring 30 at rest is slightly larger than the inner diameter 3*g* of the groove 10*g* of the body 10. The inner diameter 3*n* of the lock ring 30 at rest is slightly smaller than the outer diameter 3*f* of a flange 64 of the nose 50, which is described below. The lock ring 30 also has a plurality of apertures 36 which extend through the wall of the lock ring 30, which can line up with the apertures 16 of the body 10. Therefore, in this example there are also six apertures 36 equidistantly spaced around the surface of the lock ring 30, but in other examples there may be fewer or more apertures 36, and the apertures need not be spaced around the surface of the lock ring 30 equidistantly, regularly or symmetrically.

The radial thickness of the lock ring 30 in this example is greater than the radial depth of the groove 10*g* of the body 10 relative to the inner surface 14 of the body 10 so the lock ring 30 protrudes radially out of the groove 10*g*. In this example the axial end of the lock ring 30 which faces the first end of the body 10 is flat, and forms a flat first end face 30*f* whose plane is perpendicular to the axis of the lock ring 30. The opposing axial end of the lock ring 30 (facing the second end of the body 10) in this example includes a plurality of axially extending teeth 38. In this example all teeth 38 are identical and equidistantly spaced around the circumference of the lock ring 30 so as to form a saw tooth profile in an axial direction around the circumference of the lock ring 30. In other examples the teeth 38 need not be spaced around the circumference of the lock ring 30 equidistantly, regularly or symmetrically, and in fact a single tooth could suffice. Each tooth 38 has a steep face 39 and a gradual face 40. In this example the steep face 39 of each tooth 38 approaches a line perpendicular to the axial face 30*f* and parallel to the axis 2, while the gradual face 40 of each tooth 38 is inclined toward, but not parallel to, the flat end face 30*f*. Also in this example the steep face 39 of each tooth 38 forms a peak 41 with the gradual face 40 of the adjacent tooth 38 in a clockwise rotational direction when looking at the teeth 38 along the axis of the lock ring 30 from the second end of the body 10 (i.e. from the surface in use). In other words, the adjacent gradual face 40 in the clockwise rotational direction slopes away from and to the right of the peak 41 (when viewed from above). The peaks 41 face the second (upper) end of the body 10. Similarly in this example, the steep face 39 of each tooth 38 forms a pocket 42 with the gradual face 40 of the adjacent tooth 38 in a counter-clockwise rotational direction when looking at the teeth 38 along the axis of the lock ring 30.

The nose 50 is a generally cone-shaped member. The nose 50 includes an external portion 52 at a first (lower) axial end and an internal portion 58 at the opposing second (upper) axial end, which extends into the counter-bored first end of the body 10. When fully assembled, the external portion 52 of the nose 50 is disposed outside the bore of the body 10, while the internal portion 58 of the nose 50 is disposed within the counter-bored first end of the body 10. The external portion 52 of the nose 50 corresponding to the tip of the cone has an externally eccentric profile, and an internal cavity 54. In this example the external portion 52 of the nose 50 also has an axial bore 56 which extends between the exterior surface of the nose 50 and the internal cavity 54. The cavity 54 is generally barrel-shaped having a larger inner diameter midway along the axial length of the cavity 54 than at either axial end of the cavity 54. The external portion 52 of the nose 50 also includes a face 52*f* which in this example is disposed axially adjacent to the internal portion 58 of the nose 50. Also in this example the outer diameter of the face 52*f* is the greatest radial dimension of the nose 50.

The internal portion 58 of the nose 50 is generally cylindrical with a circular cross-section and has a bore that links to the internal cavity 54 of the external portion 52. In this example the inner diameter of the internal portion 58 of the nose 50 is constant for the majority of the axial length of the internal portion 58 from the internal cavity 54. The internal surface of the internal portion 58 then tapers radially outwardly (at the internal cavity 54) toward the axial end of the internal portion 58. The nose 50 is made from a drillable material, such as a nonferrous metal or alloy (i.e., copper, brass, bronze, aluminum, zinc, tin, or alloys thereof), a polymer, or composite.

The outer surface of the internal portion 58 of the nose 50 between the axial end of the internal portion 58 and the external portion 52 includes a boss 62, a flange 64 and a groove 50*g*. The boss 62 on the outer surface of the internal portion 58 corresponds axially with the taper of the inner surface of the internal portion 58. The flange 64 is disposed axially between the boss 62 and the groove 50*g*. In this example the outer diameter 3*m* of the boss 62 is constant. The outer diameter 3*f* of the flange 64 is greater than the outer diameter 3*m* of the boss 62, such that the flange 64 forms a first axial face or shoulder 58*s* with the boss 62. The shoulder 58*s* includes a stepped increase in the outer diameter of internal portion 58 from the boss 62 to the flange 64, and hence presents a flat annular surface whose plane is perpendicular to the axis of the nose 50, which faces the second (upper) end of the body 10. The outer diameter 3*f* of the flange 64 is also greater than the inner diameter 3*g* of the groove 50*g*. Therefore, the flange 64 forms a second opposing axial face with the groove 50*g*. In contrast to the shoulder 58*s*, the opposing second axial face of the flange 64 has a varying axial dimension and includes a plurality of teeth 66. In this example all teeth 66 are identical and equidistantly spaced around the circumference of the flange 64 so as to form a saw tooth profile around the circumference of the flange 64. In other examples the teeth 66 need not be spaced around the circumference of the flange 64 equidistantly, regularly or symmetrically. Each tooth 66 has a steep face 67 and a gradual face 68 and is formed to correspond with and be complementary to the teeth 38 of the lock ring 30. Similarly to the teeth 38 of the lock ring 30, each adjacent steep face 67 and gradual face 68 of the flange 64 form either a peak 69 which corresponds to the largest axial dimension of the flange 64, or a pocket 70 which corresponds with the smallest axial dimension of the flange 64. The teeth 66 extend axially like the teeth 38, but the teeth 66 extend towards the lower first end of the body 10 whereas the teeth 38 extend in the opposite direction, i.e. towards the upper second end of the body 10. The teeth 66 and 38 are thereby arranged to inter-engage in the locked position as will be described below.

The opposing axial side of the groove 50*g* from the flange 64 forms a face 58*f* on the outer surface of the internal portion 58 of the nose 50. The axial width of the groove 50*g* between the flange 64 and the face 58*f* is not constant due to the varying axial dimension of the teeth 66 of the flange 64. However, the smallest axial width of the groove 50*g*, which corresponds to the peaks 69 of the teeth 66, is greater than the greatest axial dimension of the lock ring 30, at the peaks 41 of the teeth 38, for reasons that will be explained below.

To assemble the guide shoe 1, the spring 20 is first inserted into the body 10 such that the axis of the spring 20 is coaxial with the axis of the body 10, until a first (upper) axial end of the spring 20 abuts the shoulder 10*s* on the inner surface of the body 10. Since the diameter 3*s* of the spring 20 is larger than the inner diameter of the inner surface of the body 10 above the shoulder 10*s*, the spring 20 is prevented from moving axially upward in the bore of the body 10 beyond the shoulder 10*s*.

The lock ring 30 is then placed within the groove 50*g* of the nose 50. The lock ring 30 is radially expanded by means of an external radially outward force (which causes the circumferential dimension of the split 32 to increase) until the inner diameter 3*n* of the lock ring 30 is slightly larger than the outer diameter 3*f* of the flange 64. The lock ring 30 is then passed over the flange 64 of the nose 50 until it is axially aligned with the groove 50*g*. When the radially outward force is removed, the lock ring 30 returns to its resiliently biased resting shape, in which the inner diameter 3*n* of the lock ring 30 is smaller than the outer diameter 3*f* of the flange 64 and smaller than the outer diameter of the face 58*f* of the internal portion 58 of the nose 50. Once the lock ring 30 has snapped back into its resiliently biased resting shape in the groove 50*g*, it has a limited range of axial movement relative to the nose 50. As described previously, the smallest axial width of the groove 50*g* is greater than the greatest axial dimension of the lock ring 30. Therefore, when the lock ring face 30*f* is in contact with the internal portion face 58*f* of the nose 50, the teeth 38 of the lock ring 30 do not overlap axially with the teeth 66 of the flange 64, and so the lock ring 30 is free to move rotationally in the groove 50*g* around the axis of the nose 50 in both clockwise and anticlockwise directions as shown by arrow 4*c*.

Once the lock ring 30 is in position within the groove 50*g* of the nose 50, the internal portion 58 of the nose 50 is then moved or pushed axially relative to the body 10 into the bore of the body 10 through the counter-bored first (lower) end. The boss 62 first moves axially into a second axial end of the spring 20, until the second axial end of the spring 20 abuts the shoulder 58*s* of the internal portion 58 of the nose 50. As the internal portion 58 continues to move axially into the bore of the body 10, the spring 20 is compressed between the shoulder 10*s* of the body 10 and the shoulder 58*s* of the internal portion 58 until the lock ring 30 engages a bevel on the face 10*f* of the body 10. Since the outer diameter 3*o* of the lock ring 30 at rest is greater than the inner diameter 3*b* of the inner surface 14 of the body 10, the outer diameter 3*o* of the lock ring 30 must be decreased to allow the nose 50 to be moved further into the body 10. The lock ring 30 is radially compressed by means of an external radially inward compression on the lock ring 30 which causes the circumferential dimension of the split 32 to decrease as it passes through the bevel on the face 10*f*, which in turn decreases the outer diameter 3*o* of the lock ring 30, compressing it radially inwards as the lock ring 30 moves into the bore of the body 10.

Once the outer diameter 3*o* of the lock ring 30 has reduced sufficiently to allow the lock ring 30 to be inserted into the bore of the body 10 past the face 10*f* of the body 10, the external radially inward compression can be removed as the lock ring 30 is now held in the radially compressed shape by the inner diameter 3*b* of the body 10, against which the lock ring 30 is resiliently urged. The internal portion 58 of the nose 50 can then be moved or pushed further axially relative to the body 10 into the bore of the body 10, until the entire axial length of the lock ring 30 has moved into axial alignment with the groove 10*g* of the body 10. The lock ring 30 will then snap radially outwardly as it returns toward its resiliently biased resting shape and increase its outer diameter 3*o* in the groove 10*g* until the outer surface 34 of the lock ring 30 is urged against the inner surface of the groove 10*g*. The outer diameter 3*o* of the lock ring 30 is now greater than the diameter 3*b* of the inner surface 14 of the body 10, so the axial movement of the lock ring 30 is limited to the axial movement of the lock ring 30 in the groove 10*g*, or in other words the range of axial movement of the nose 50 relative to the body 10 is dependent on the axial width of the groove 10*g*. Once the lock ring 30 is in position in the groove 10*g*, the apertures 36 in the lock ring 30 are aligned with the apertures 16 in the body 10 and pins 18 inserted through each pair of aligned apertures in the lock ring 30 and body 10. The pins 18 therefore prevent rotation of the lock ring 30 relative to the body 10, and in this example, the pins 18 also prevent axial movement of the lock ring 30 relative to the body 10. The pins 18 are secured into place by interference fit into the apertures 16.

Figure 3:
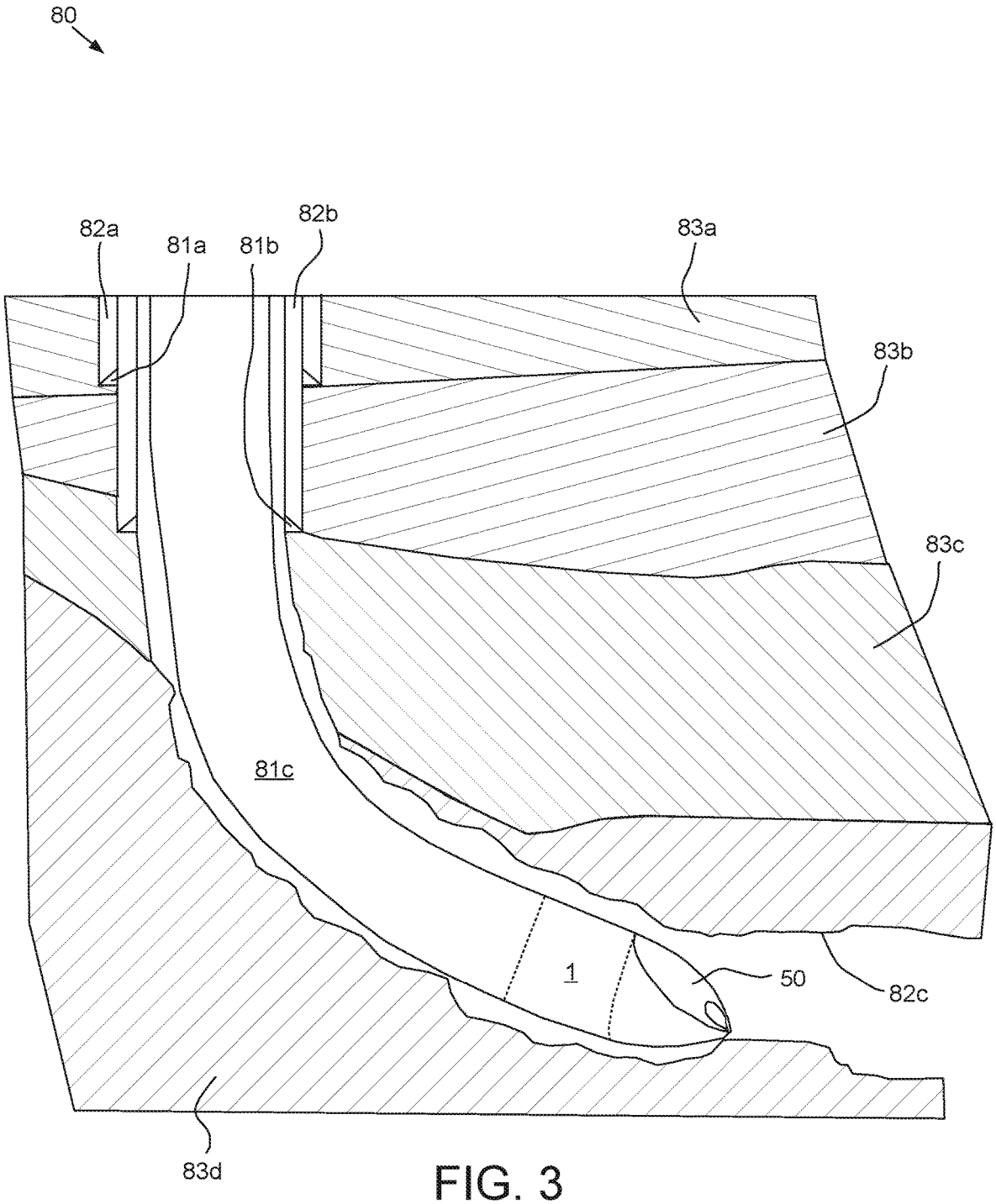
FIG. 3 illustrates the guide shoe assembled as part of a casing string and deployment of the casing string into a wellbore.

FIG. 3 illustrates the guide shoe assembled as part of a casing string and deployment of the casing string into a wellbore. The well 80 has two existing strings of casing 81*a,b* set in earlier bores 82*a,b*. The bores 82*a-c* have sequentially decreasing diameter, as have the casing strings 81*a-c*.

In operation, the guide shoe 1 is typically fixed to the bottom end of a casing or liner string 81*c* and then run into the wellbore 82*c* of an oil or gas well with the guide shoe 1 at the leading end of the string. The guide shoe 1 is biased by the spring 20 into the locked position, and will remain in this position as long as the nose 50 of the guide shoe 1 does not contact any obstructions in the wellbore 82*c*. In the locked position the nose 50 is biased axially toward an extended axial position relative to the body 10 by the spring 20, and the gradual faces 40 of the teeth 38 of the lock ring 30 rest against the gradual faces 68 of the teeth 66 of the flange 64. In this extended position the rotation of the nose 50 in a clockwise direction (in the direction of arrow 4*b*) relative to the body 10 (when viewed from the top of the string 81*c*) is limited by the steep faces 39 of the teeth 38 on the rotationally fixed lock ring 30 engaging with the steep faces 67 of the teeth 66 on the rotating nose 50 which prevents any further clockwise rotation of the nose 50 relative to the body 10. Hence, only very limited rotation is permitted in this direction (or none) until the steep faces 67/39 engage. However, in this extended position the nose 50 is able to rotate in a counter-clockwise direction relative to the body 10 (in the direction of the arrow 4*a*). When the nose 50 is urged to rotate in a counter-clockwise direction by, for example, a partial obstruction in the wellbore 82*c*, the gradual faces 68 of the teeth 66 of the flange 64 on the rotating nose 50 slide against the gradual faces 40 of the teeth 38 of the rotationally fixed lock ring 30. This relative sliding movement and the slope of the faces on the teeth also causes the internal portion 58 of the nose 50 to be slightly axially retracted into the bore of the body 10, to energize the spring 20 until the gradual face 68 of each tooth 66 has rotated counter-clockwise fully past the gradual face 40 of its corresponding tooth 38. At this point the peaks 69 of the teeth 66 are in rotational alignment with the peaks 41 of the teeth 38. As the peaks 69 rotate past the peaks 41, the teeth 66 are no longer in contact with the teeth 38 and the spring 20 again urges the nose 50 axially out of the body 10 toward the extended axial position until the peaks 69 of the teeth 66 engage with the pockets 42 of the teeth 38. Thus, in the locked position, rotation is limited or prevented in a clockwise direction (in the direction of arrow 4*b*), but is permitted in a counter-clockwise direction (in the direction of arrow 4*a*).

If the nose 50 of the guide shoe 1 comes into contact with an obstruction in the wellbore, the nose 50 can optionally rotate in a counter-clockwise direction while still locked against clockwise rotation, and rotate around the obstruction. If the nose 50 is not able to pass the obstruction by means of counter-clockwise rotation, the nose 50 is pushed against the obstruction, which applies compressive force to the nose 50 in a direction along the axis of the body as the string continues to move into the wellbore relative to the obstructed nose 50. This compressive force causes the spring 20 to be compressed between shoulder 10*s* of the body 10 and shoulder 58*s* of the internal portion 58 of the nose 50, and the nose 50 to move axially into the body 10. The axial compressive force required to compress the spring 20 is relatively small, and in this example is between approximately 50 and 100 newtons (10 and 20 pounds) of force. The internal portion 58 of the nose 50 moves axially into the counter-bored first (lower) end of the body 10 until either the face 30*f* of the lock ring 30 abuts the face 58*f* of the internal portion 58 of the nose 50, or the face 10*f* of the body 10 abuts the face 52*f* of the external portion 52 of the nose 50 (the latter is a better option as this avoids or reduces loading on the pins 18. The guide shoe is now in the unlocked position. When the nose 50 is in this retracted axial position relative to the body 10, the teeth 66 of the nose 50 are spaced axially from the teeth 38 of the lock ring 30 and so the teeth 66, 38 do not engage with each other. Therefore, the nose 50 can rotate freely in either a clockwise or counter-clockwise direction relative to the body 10 to find a way past the obstruction in the wellbore. The guide shoe 1 will typically then be able to guide the casing or liner string 81*c* past the partial obstruction in the wellbore.

The bore 82*c* most recently drilled has various obstructions protruding into the bore, particularly as the bore transitions from one formation 83*a-d* to another, and this has caused the nose 50 of the shoe 1 to unlock in response to the force applied to it by the weight of the string 81*c* behind it, and the nose 50 then rotates in a counter clockwise direction, in order to guide the shoe past the obstruction as previously described. If sufficient weight is placed on the shoe 1 from the string 81*c*, the locking mechanism is unlocked, and the shoe is freed to rotate in both a counter clockwise direction and/or a clockwise direction. When the required depth is reached by the string 81*c*, the string is pulled up slightly to unweight the nose 50 and shift it into the locked position, restricting the rotational extent of movement possible for the nose 50 in the clockwise direction of the arrow 4*b*.

Once the casing or liner string 81*c* to which the guide shoe 1 is fixed has reached the desired depth in the existing wellbore 82*c*, the string and guide shoe are typically cemented in place in the wellbore. In this example, prior to cementing the string and guide shoe 1, the string can optionally be raised, or in other words pulled back, a short distance up the wellbore to ensure that the nose 50 of the guide shoe 1 is not in contact with any obstruction in the wellbore. This ensures that the guide shoe 1 is biased by the spring 20 into the locked position. If the wellbore is to be drilled further, a drill string can be run into the wellbore through the casing or liner string 81*c*, which will first drill through the nose 50 of the guide shoe at the bottom of the casing or liner string. Conventionally rotary drill strings are rotated in a clockwise direction (when viewed from the surface) and referred to as turning to the right, so drilling through the guide shoe 1 is facilitated if the guide shoe is in the locked position, in which clockwise rotation of the nose 50 with respect to the body 10 is prevented. Typically the nose 50 of the guide shoe 1 is initially prevented from clockwise rotation by the cement surrounding it in the wellbore, but it is generally expected that in some cases, the nose 50 can break free from the surrounding cement as the drill string drills through the nose. In this case, the nose 50 is still prevented from clockwise rotation due to the guide shoe 1 being in the locked position, even if freed from cement.

Figure 4A:
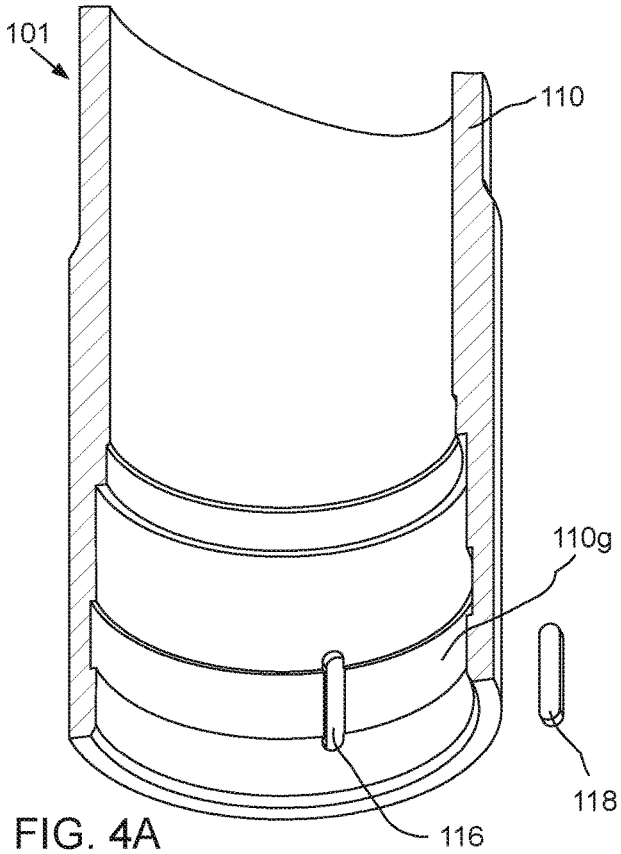
FIG. 4A illustrates a second guide shoe with a lockable nose, according to another embodiment of the present disclosure.

FIG. 4A illustrates a second guide shoe 101 with a lockable nose, according to another embodiment of the present disclosure. The second guide shoe 101 includes a second body 110, the resilient biasing device in the form of the spring 20, a locking mechanism including the lock ring 30, and the nose 50. The second body may be made from the same material as discussed above for the body 10.

The groove 110*g* of the second body 110 has a key aperture 116 instead of a plurality of apertures 16 in the groove 10*g* of the body 10 as for the guide shoe 1. The key aperture 116 extends through the wall of the body 110 between the inner and outer surfaces of the body 110 and has an axis perpendicular to the axis of the body 110. In this example there is one key aperture 116, but in other examples there may be more than one key aperture 116. Also in this example the key aperture 116 has a larger dimension in the direction of the axis 2 of the body 110 than its circumferential dimension, and is hence generally rectangular in shape. Furthermore in this example the key aperture 116 is disposed in the wall of the body 100 parallel to the axis of the body 110, and the dimension in the direction of the axis 2 of the body 110 is greater than the axial width of the groove 110*g* of the body 110. Again in this example the shape of the key aperture 116 generally corresponds to the shape of the split 32 in the lock ring 30.

The second guide shoe 101 is assembled in generally the same way as described previously for the guide shoe 1. A key 118 is inserted into the key aperture 116 before the internal portion of the nose 50 is pushed axially into the bore of the body 110. The key 118 may be secured into place by interference fit into the key aperture 116. In this example the profile of the key 118 generally corresponds to the shape of the key aperture 116. Also in this example the axial depth of the key 118 is approximately equal to the sum of the radial thickness of the wall of the body 110 within the groove 110*g* and the radial thickness of the lock ring 30. The key 118 is inserted into the key aperture 116 such that the key 118 is retained within the key aperture 116 but protrudes radially inwardly from the inner surface of the groove 110*g*, at least partially, to engage with the split 32 of the lock ring 30. In this example, the key 118 does not protrude radially inwardly from the inner surface of the groove 110*g* further than the depth of the groove 110*g* relative to the inner surface of the body 110. In other words, in this example the clearance between the radially innermost surface of the key 118 and the axis 2 of the body 110 is approximately equal to or greater than the inner diameter 3*b* of the body 110.

As the internal portion of the nose 50 is inserted into the body 110, the lock ring 30 is rotated until the split 32 in the lock ring 30 is rotationally aligned with the key 118 in the groove 110*g*. Therefore the key 118 engages in the split 32 of the lock ring 30, in other words, between the two adjacent ends of the lock ring thereby resisting rotation of the lock ring 30 in the groove 110*g*. As the axial length of the lock ring 30 comes into axial alignment with the groove 110*g*, the key 118 slides axially into the split 32. Once the lock ring 30 is in axial alignment with the groove 110*g*, the lock ring 30 snaps radially outwardly as it returns toward its resiliently biased resting shape and the outer surface of the lock ring 30 comes to rest against the inner surface of the groove 110*g* on either side of the key 118. As with the guide shoe 1, the groove 110*g* limits the axial movement of the lock ring 30 relative to the body 110 to the axial movement of the lock ring 30 in the groove 110*g*, and in this example, the key 118 prevents rotation of the lock ring 30 relative to the body 110.

Once assembled, the operation of the second guide shoe 101 is substantially the same as the operation of the guide shoe 1.

Figure 4B:
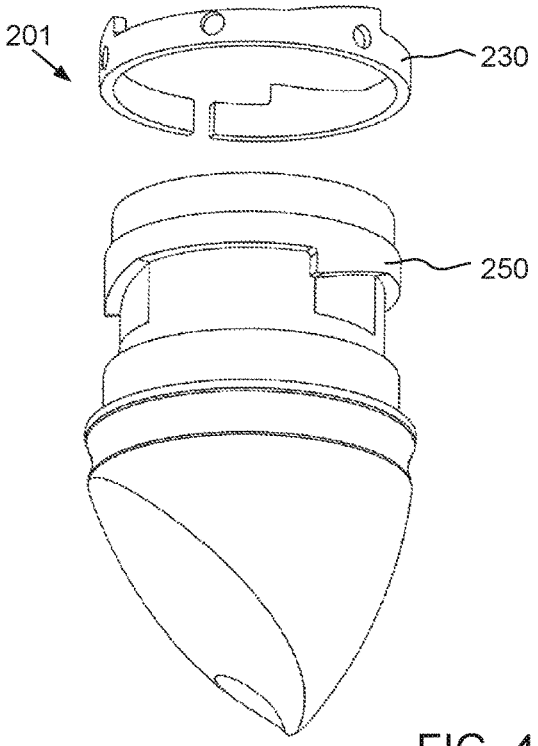
FIG. 4B illustrates a third guide shoe with a lockable nose, according to another embodiment of the present disclosure.
Figure 4C:
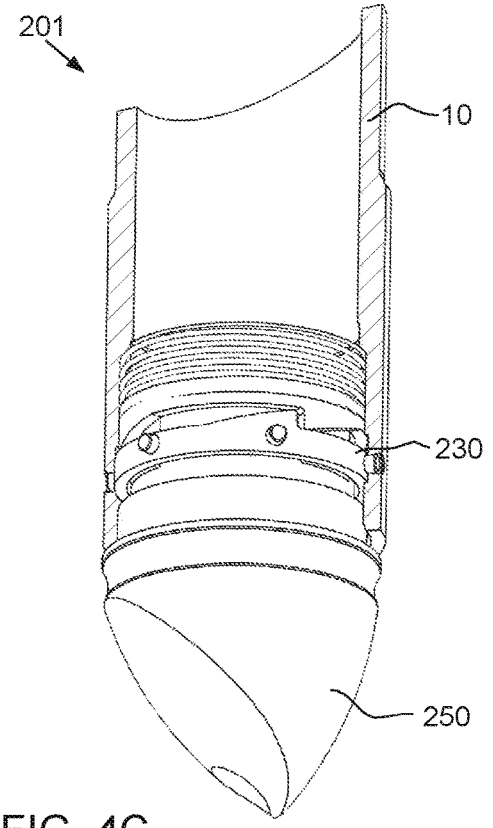
FIG. 4C illustrates the third guide shoe in the locked position.
Figure 4D:
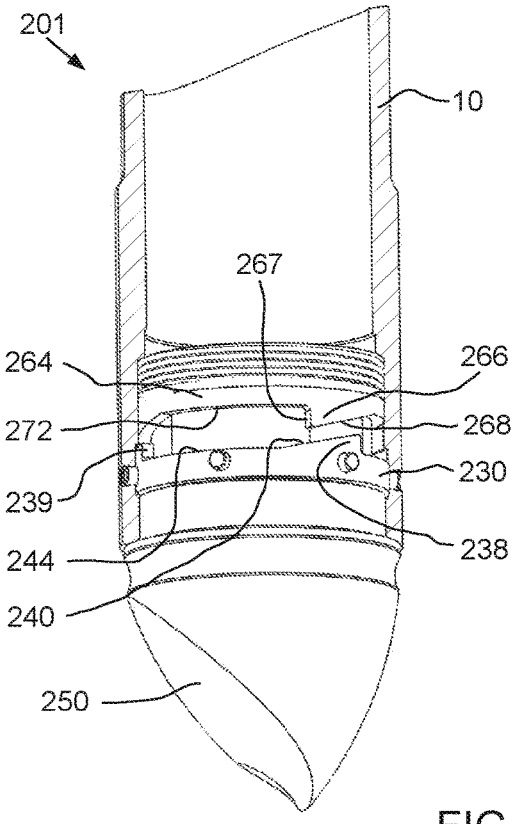
FIG. 4D illustrates the third guide shoe in the unlocked position.

FIG. 4B illustrates a third guide shoe 201 with a lockable nose, according to another embodiment of the present disclosure. FIG. 4C illustrates the third guide shoe 201 in the locked position. FIG. 4D illustrates the third guide shoe 201 in the unlocked position. The third guide shoe 201 includes the body 10 (or the second body 110), the resilient biasing device in the form of the spring 20, a locking mechanism including a second lock ring 230, and a second nose 250. The second nose 250 may be made from the same material as discussed above for the nose 50. The second lock ring 230 may be made from the same material as discussed above for the lock ring 30.

The lock ring 230 and flange 264 have only three teeth 238 and 266 respectively. As for the guide shoe 1, the teeth 238 and 266 are identical and equidistantly spaced around the circumferences of the lock ring 230 and flange 264 respectively, but in other examples the teeth 238 and 266 need not be spaced equidistantly, regularly or symmetrically.

In contrast to the teeth 38 and 66 for the guide shoe 1, the teeth 238 and 266 do not have well defined pockets. This is due to the greater circumferential spacing of the teeth 238 and 266 which leaves a circumferential gap between the gradual faces 240 and 268 of each tooth 238 and 266, and the steep faces 239 and 267 of each adjacent tooth 238 and 266 respectively. In other words, in addition to the steep faces 239 and 267, and gradual faces 240 and 268, each of the lock ring 230 and flange 264 have third flat faces 244 and 272 respectively. The flat faces 244 and 272 therefore present discontinuous flat partially annular surfaces whose planes are perpendicular to the axis of the lock ring 230 and nose 250 respectively.

In operation, the third guide shoe 201 functions in a similar way to the guide shoe 1. When in the unlocked position, the teeth 266 of the nose 250 are spaced axially from the teeth 238 of the lock ring 230 and so the teeth 266, 238 do not engage with each other. Therefore, in the unlocked position, the nose 250 can rotate freely in either a clockwise or counter-clockwise direction relative to the body 210 without engagement of the teeth 266, 238. When in the locked position, the nose 250 is able to rotate in a counter-clockwise direction relative to the body 210, as described in the first example. In the locked position, the rotation of the nose 250 in a clockwise direction relative to the body 210 is also limited by the steep faces 239 of the teeth 238 of the lock ring 230 engaging with the steep faces 267 of the teeth 266 of the flange 264, which prevents any further clockwise rotation of the nose 250 relative to the body 210. However, the greater circumferential spacing of the teeth 266, 238 around the nose 250 and lock ring 230 respectively typically allows rotation in a clockwise direction for a greater fraction of a complete revolution of the nose 250 before the teeth 266,238 engage with each other. Therefore, rotation of the nose 250 in a clockwise direction relative to the body 210 of the guide shoe 201 is typically not so limited as for similar rotation of the nose 50 of the guide shoe 1. It will be appreciated that a single tooth on each of the lock ring and nose could achieve the same effect, simply permitting at most nearly a full rotation of the nose relative to the body before the teeth engaged and further clockwise rotation of the nose was thereby prevented.

While the foregoing is directed to embodiments of the present disclosure, other and further embodiments of the disclosure may be devised without departing from the basic scope thereof, and the scope of the invention is determined by the claims that follow.

The invention claimed is:

1. A guide shoe adapted for connection to an end of a tubular for deployment in a wellbore of an oil gas or water well, the guide shoe comprising:

a body having an axis and being adapted for connection to the tubular such that torque can be transmitted between the tubular and the body;

a nose adapted for connection to the body;

a locking mechanism comprising a lock ring which is fixed to one of the body and the nose and wherein the other of the body and the nose incorporates a groove which is adapted to receive the lock ring, and which has a profile with at least one asymmetric pocket to engage with at least one asymmetric tooth on the lock ring, and wherein the groove has an axial dimension that permits the lock ring to freely rotate within the groove without engaging the at least one asymmetric tooth with the at least one asymmetric pocket;

wherein the locking mechanism is adapted to shift between an unlocked configuration, in which free rotation of the nose around the axis of the body is permitted in first and second directions, and a locked configuration in which the nose can rotate in the first direction around the axis of the body, and wherein rotation of the nose in the second direction is prevented;

wherein the locking mechanism indexes rotation of the nose around the axis of the body, permitting at least one stop per rotation of the nose around the axis of the body at an indexed position with movement only being possible in one direction in a series of irreversible steps while the locking mechanism is in the locked configuration;

wherein the guide shoe further comprises a resilient biasing device urging the nose into the locked configuration; and wherein the locking mechanism is arranged to shift from the locked to the unlocked configuration in response to compressive force applied to the nose along the axis of the body.

2. A guide shoe as claimed in claim 1, wherein the locking mechanism is arranged to shift from the locked to the unlocked configuration in response to axial movement of the nose into the body.

3. A guide shoe as claimed in claim 1, wherein the asymmetric tooth has a first face which faces the first direction and a second face which faces the second direction, wherein the slope of the first face is less than the slope of the second face, and wherein when the locking mechanism is in the locked configuration, the rotation of the nose in the first direction is permitted by relative sliding of the asymmetric tooth and pocket along the first face of the tooth, while rotation of the nose in the second direction is prevented by abutting of the second face of the asymmetric tooth with the pocket.

4. A guide shoe as claimed in claim 1, wherein the locking mechanism generates some resistance to rotation of the nose around the axis in the first direction.

5. A guide shoe as claimed in claim 1, wherein the lock ring comprises a split ring.

6. A guide shoe as claimed in claim 1, wherein the groove has a radial depth equal to or greater than the radial dimension of the lock ring.

7. A guide shoe as claimed in claim 1, wherein the lock ring is radially resilient.

8. A guide shoe as claimed in claim 1, wherein the lock ring is secured to the body by at least one key which resists rotation of the lock ring relative to the body.

9. A guide shoe as claimed in claim 8, wherein the key comprises at least one pin mounted in at least one aperture in the body.

10. A guide shoe as claimed in claim 1, wherein the nose has the groove, wherein the groove is a first groove, wherein the lock ring is radially resilient and is adapted to be expanded radially by a radial expansion force to fit over a section of the nose at the inner end of the nose, and wherein upon removal of the radial expansion force, the lock ring is adapted to radially contract such as that at least a part of the lock ring is disposed in the first groove of the nose.

11. A guide shoe as claimed in claim 10, wherein the body comprises a second groove, wherein each groove receives at least a portion of the lock ring, and wherein the resilient bias of the lock ring is chosen such that at rest, the lock ring adopts a radial position straddling the boundaries of the first and second grooves in the nose and the body.

12. A guide shoe as claimed in claim 1, wherein the resilient biasing device is maintained in compression and is adapted to compress in response to compressive force applied to the nose along the axis of the body.

13. A method of deploying a tubular in a wellbore of an oil gas or water well, the method comprising:

connecting the guide shoe of claim 1 on the end of the tubular, running the tubular and guide shoe into the wellbore, in response to encountering an obstruction in the wellbore, rotating the nose freely in the first direction and preventing rotation of the nose in the second direction when the locking mechanism is in the locked configuration, in response to failing to pass the obstruction, shifting the locking mechanism into the unlocked configuration by applying compressive force to the nose and rotating the nose freely around the axis of the body in both the first and second directions.

* * * * *